US009703261B2

(12) United States Patent
Vouillamoz

(10) Patent No.: US 9,703,261 B2
(45) Date of Patent: Jul. 11, 2017

(54) LOW VOLUME PRECISION BELLOWS

(71) Applicant: PRECIFLEX SA, Biel (CH)

(72) Inventor: Lucien Vouillamoz, Feusisberg (CH)

(73) Assignee: Preciflex SA, Neuchâtel (CH)

( * ) Notice: Subject to any disclaimer, the term of this patent is extended or adjusted under 35 U.S.C. 154(b) by 171 days.

(21) Appl. No.: 14/362,920

(22) PCT Filed: Dec. 10, 2012

(86) PCT No.: PCT/IB2012/002641
§ 371 (c)(1),
(2) Date: Jun. 5, 2014

(87) PCT Pub. No.: WO2013/084057
PCT Pub. Date: Jun. 13, 2013

(65) Prior Publication Data

US 2014/0328146 A1 Nov. 6, 2014

Related U.S. Application Data

(60) Provisional application No. 61/568,197, filed on Dec. 8, 2011.

(51) Int. Cl.
*G04B 1/26* (2006.01)
*F04B 53/14* (2006.01)

(52) U.S. Cl.
CPC ..... *G04B 1/265* (2013.01); *F04B 53/14* (2013.01)

(58) Field of Classification Search
CPC ..... G04B 1/265
USPC ..... 368/65
See application file for complete search history.

(56) References Cited

U.S. PATENT DOCUMENTS 4,226,082 A * 10/1980 Nishida ..... C23C 14/0015 368/285
5,259,842 A 11/1993 Plechinger
6,485,471 B1 11/2002 Zivitz
7,605,777 B2 * 10/2009 Furetta ..... G02B 26/004 345/34
2005/0277882 A1 12/2005 Kreisel

FOREIGN PATENT DOCUMENTS

JP 58-029020 A 2/1983
JP 08-004702 A 1/1996
WO WO 2011/021097 2/2011

* cited by examiner

*Primary Examiner* — Amy Cohen Johnson
*Assistant Examiner* — Jason Collins
(74) *Attorney, Agent, or Firm* — Da Vinci Partners LLC; John Moetteli

(57) ABSTRACT

A bellows is provided for fluid storage and displacement used in precise fluid indication in a capillary tube. The bellows is made of a housing made of flexible, watertight material. The housing is made up of an upper portion, a lower portion, and an outer accordion formed portion. The accordion formed portion has a length/and is sealingly connected along a periphery between the upper and lower portions. At least one entry/exit port is formed on at least one of the portions thereof. At least one of the upper and lower portions extends from a periphery of the accordion formed portion substantially within the housing so as to reduce the storage volume.

17 Claims, 7 Drawing Sheets

LOW VOLUME PRECISION BELLOWS

CROSS REFERENCE TO RELATED APPLICATIONS

This application claims the benefit of U.S. Provisional Application No. 61/568,197, filed Dec. 8, 2011, the content of which is incorporated herein by reference thereto.

COPYRIGHT & LEGAL NOTICE

A portion of the disclosure of this patent document contains material which is subject to copyright protection. The Applicant has no objection to the facsimile reproduction by anyone of the patent document or the patent disclosure as it appears in the Patent and Trademark Office patent file or records, but otherwise reserves all copyright rights whatsoever. Further, no references to third party patents or articles made herein are to be construed as an admission that the present invention is not entitled to antedate such material by virtue of prior invention.

BACKGROUND OF THE INVENTION

This invention relates to bellows for storing and dispensing fluids in a controlled manner. In particular, the invention related to bellows for storing and dispensing fluids in a capillary tube indicator.

What is needed is a method of interfacing with a large actuator while dispensing with a small amount of fluid, in order to prevent thermal expansion or contraction of the fluid from significantly impacting the accuracy of the system.

SUMMARY OF THE INVENTION

A bellows is provided for fluid storage and displacement used in precise fluid indication in a capillary tube. The bellows defines a housing made of flexible, watertight material. The housing is made up of an upper portion, a lower portion, and an outer accordion formed portion. The accordion formed portion has a length l and is sealingly connected along a periphery between the upper and lower portions. At least one entry/exit port is formed on at least one of the portions thereof. At least one of the upper and lower portions extends from a periphery of the accordion formed portion substantially within the housing so as to reduce the storage volume within the bellows.

An object of the invention is to provide a large interface to an actuation device while containing and precisely controlling a small volume of fluid in order to minimize the impact of thermal expansion or contraction of the fluid.

Another object of the invention is to control a small volume of fluid which enters a preferably transparent capillary tube.

Those skilled in the art will appreciate that elements in the Figures are illustrated for simplicity and clarity and have not necessarily been drawn to scale. For example, dimensions may be exaggerated relative to other elements to help improve understanding of the invention and its embodiments. Furthermore, when the terms 'first', 'second', and the like are used herein, their use is intended for distinguishing between similar elements and not necessarily for describing a sequential or chronological order. Moreover, relative terms like 'front', 'back', 'top' and 'bottom', and the like in the Description and/or in the claims are not necessarily used for describing exclusive relative position. Those skilled in the art will therefore understand that such terms may be interchangeable with other terms, and that the embodiments described herein are capable of operating in other orientations than those explicitly illustrated or otherwise described.

DETAILED DESCRIPTION OF THE PREFERRED EMBODIMENT(S)

The following description is not intended to limit the scope of the invention in any way as they are exemplary in nature, serving to describe the best mode of the invention known the inventors as of the filing date hereof. Consequently, changes may be made in the arrangement and/or function of any of the elements described in the exemplary embodiments disclosed herein without departing from the spirit and scope of the invention.

Figure 1:
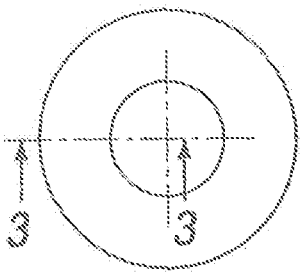
FIG. 1 is a perspective view of the bellows of the invention.
Figure 2:
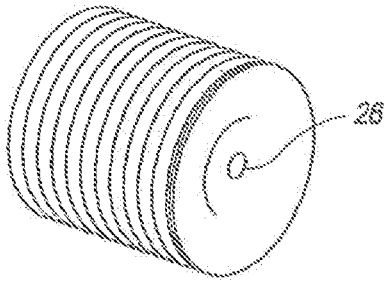
FIG. 2 is a top view of the bellows of the invention.
Figure 3:
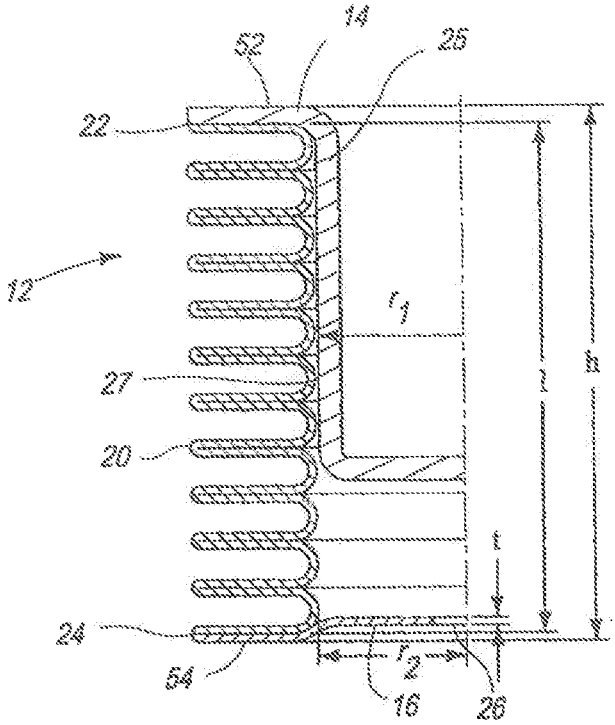
FIG. 3 is a partial cross sectional view of the bellows of the invention, taken along line A-A of FIG. 2.

Referring now to FIGS. 1-3, a bellows 10 is provided for fluid storage and displacement used in precise fluid indication in a capillary tube. The bellows 10 delimits a housing 12 made of flexible, watertight material. The housing 12 is made up of an upper portion 14, a lower portion 16, and an outer accordion formed portion 20. Each portion may be of a differing material or be coated or partially coated via a masking so that at least a portion of which has a certain coating and the remaining portion another coating or none at all, assuming that the process for assembly of the portions 14, 16 and 20 (laser, ultrasonic or friction welding, epoxy or adhesive, brazing or soldering, for example) is compatible therewith. The accordion formed portion 20 has a length l and is sealingly connected along a periphery 22, 24 between the upper and lower portions 14 and 16. The sealing may be accomplished via an adhesive or epoxy bond, or a brazing or other welding or soldering process, known in the art. Laser or ultrasonic welding may also be used. At least one entry/exit port 26 is formed on at least one of the portions thereof. At least one of the upper and lower portions 14, 16 extends from a periphery 22, 24 of the accordion formed portion 20 substantially within the housing 12 so as to reduce the storage volume within the bellows 10. Such an inwardly extending portion 14 or 16 may have a hat-shaped cross-section 25. The outer wall 27 of the hat-shape has a radius r1 which is slightly less than the innermost radius r2 of the bellows 10.

In one embodiment, the bellows 10 is made at least in part, of plastic.

In another embodiment, the bellows 10 is made, at least in part, of a metal such as brass.

In another embodiment, the bellows 10 is made, at least in part, of copper.

In another embodiment, the bellows 10 is made, at least in part, of beryllium copper.

In another embodiment, the bellows 10 is made, at least in part, of a shape memory alloy.

In another embodiment, the bellows 10 is made, at least in part, of aluminium.

The bellows 10 may optionally be coated, at least in part, with a brilliant coating such as gold or titanium nitride. Alternative, the bellows is electrocoated, at least in part, with a titanium nitride coating or a copper coating. Any portion of the bellows made of aluminium may be oxide coated in a variety of colors.

Figure 4:
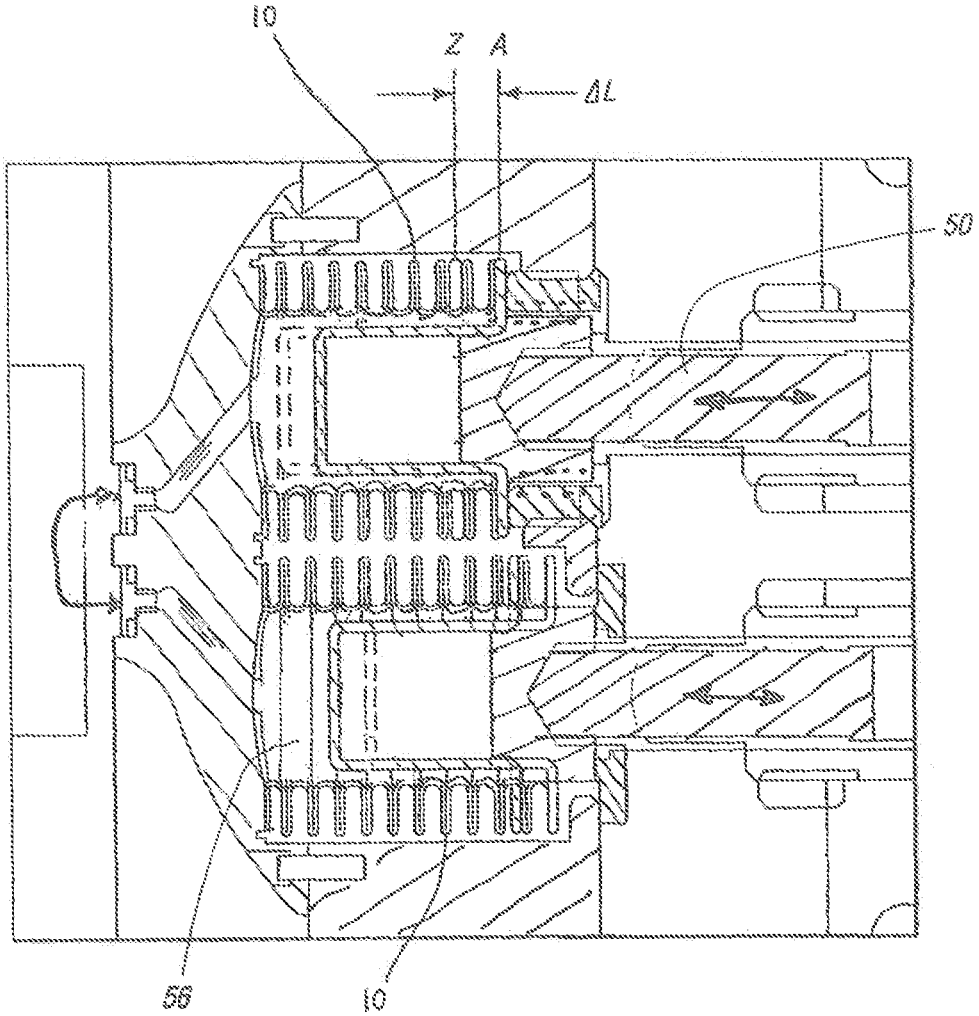
FIG. 4 is a schematic cross sectional view of the bellows of the invention, taken along the plane passing through the axes of the pistons, applied to a fluid watch.

Referring now to FIG. 4, the bellows 10 is particularly applicable to control the meniscus of a fluid indicator of a fluid watch, such as that described in WO 2011/021097 A4, and U.S. Provisional Appl. No. 61/567,497, filed Dec. 6, 2011, the content of which are incorporated herein by reference thereto.

In this figure, it can be seen that the piston shaft 50 is large compared to the displacement distance delta L required to fully actuate the bellows 10 (from position A to position Z). Further, given the thickness t (shown in FIG. 3) of the material from which the bellows 10 is made, a certain height h (shown in FIG. 3) of the bellows 10 is required and elastic expansion should be restricted in all directions but the control or actuation direction. Normally, one would be motivated to simply use a cap formed as the lower portion 16 to seal both ends 52 and 54 of the bellows 10. However, if this is done, then a large volume of fluid would be contained in the bellows 10. A large volume of fluid then is subject to a larger amount of thermal expansion when the ambient temperature varies say between −10 and 50 degrees Celsius, which, when the fluid volume is used as an indication medium, results in large variations in the position of a meniscus particularly in a capillary tube. When such capillary tube is used to indicate time, for example, such variance results in a capillary indication system being unusable for indicating time, at least not with any accuracy during large temperature variations. The solution of the invention overcomes this problem by minimizing the volume 56 of the fluid handled in such a system, while allowing for an interface with a larger actuator 50, thereby minimizing fluctuation of the position of the meniscus caused by temperature variation.

Figure 5:
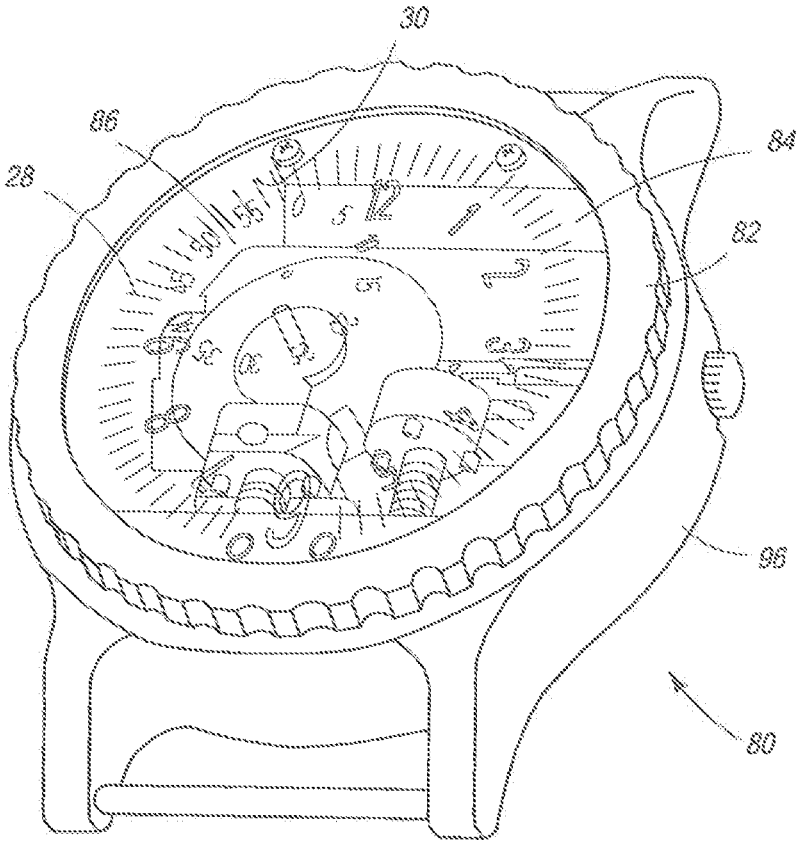
FIG. 5 is a perspective, partially transparent view of a timepiece of the invention.
Figure 6:
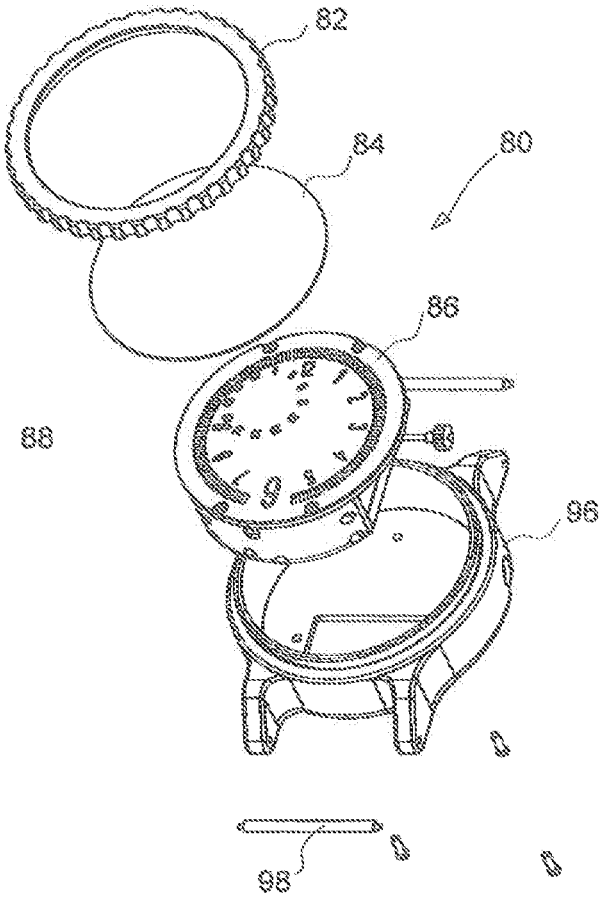
FIG. 6 is an exploded view of the timepiece of FIG. 5.

Referring now to FIGS. 5 and 6, in another embodiment, the invention is embodied in a wristwatch 80. The wristwatch 80 includes a bezel 82, a crystal 84, an at least partially transparent dial 86, a watch mechanism 88 which includes a fluid displacement device 90 (shown in FIG. 7), a capillary manifold 92 (shown in FIG. 7), a watch movement subassembly 94 (shown in FIG. 8), and a case body 96. In a known manner, the bezel 82 encapsulates the crystal 84 against the watch mechanism 88 against the case body 96, sealing the watch mechanism within an exterior housing against the elements (rain, water, snow, etc). Note that the lower part of the casing can also be transparent, to expose the inner workings of the watch to the user. A bracelet pin 98 is provided, to attach a bracelet (not shown).

Figure 7:
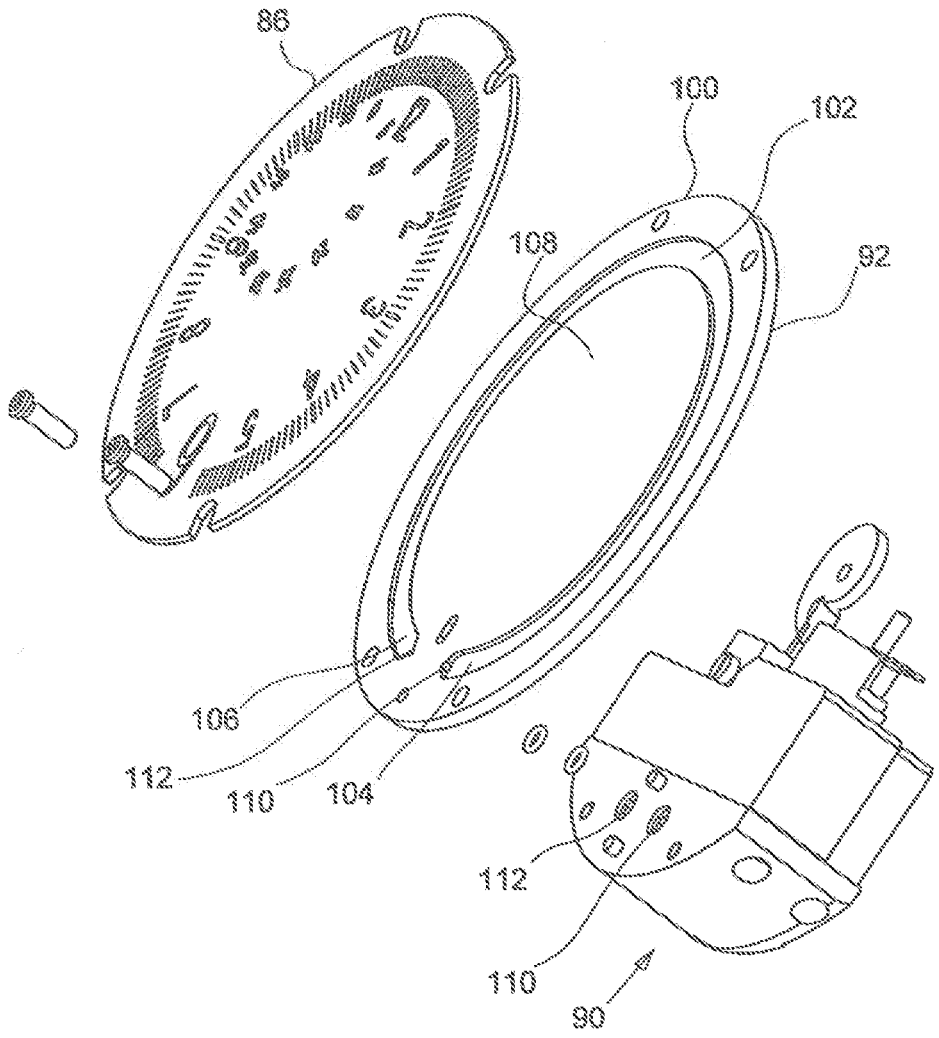
FIG. 7 is a perspective, exploded view of the face, capillary tube and fluid displacement device of the timepiece of FIG. 5.

Referring now to FIG. 7, the capillary manifold 92 of the wristwatch 80 is formed of a flat, round plate 100. A circumferential capillary channel 102 is formed in the plate 100, the channel extending proximate the external periphery about 355 degrees, at which end points 104 and 106 are located annular passages 110 and 112 which, when the dial 86 is sealingly fastened against an upper surface 108 and the fluid displacement device 90 is fastened against the lower surface thereof, enable a fluid 113 to pass therethrough from respective fluid reservoirs 114 and 116 (shown in FIG. 10). Note that the channel 102 may extend 360 degrees, provided that the end points are positioned adjacent each other (located, with one end 106 slightly raised and the other end 106 slightly lowered (or vice versa, or alternatively, located one above the other) in a spiral-like form. Of course, the capillary channel 102 may take any form, not merely circumferential, provided that time is indicated accurately. The said fluid 113 passes via channels 120 and 122 into the circumferential channel 102. The fluid reservoirs 114 and 116 are thereby in fluid communication via these passages 110 and 112 and channels 120 and 122.

Figure 8:
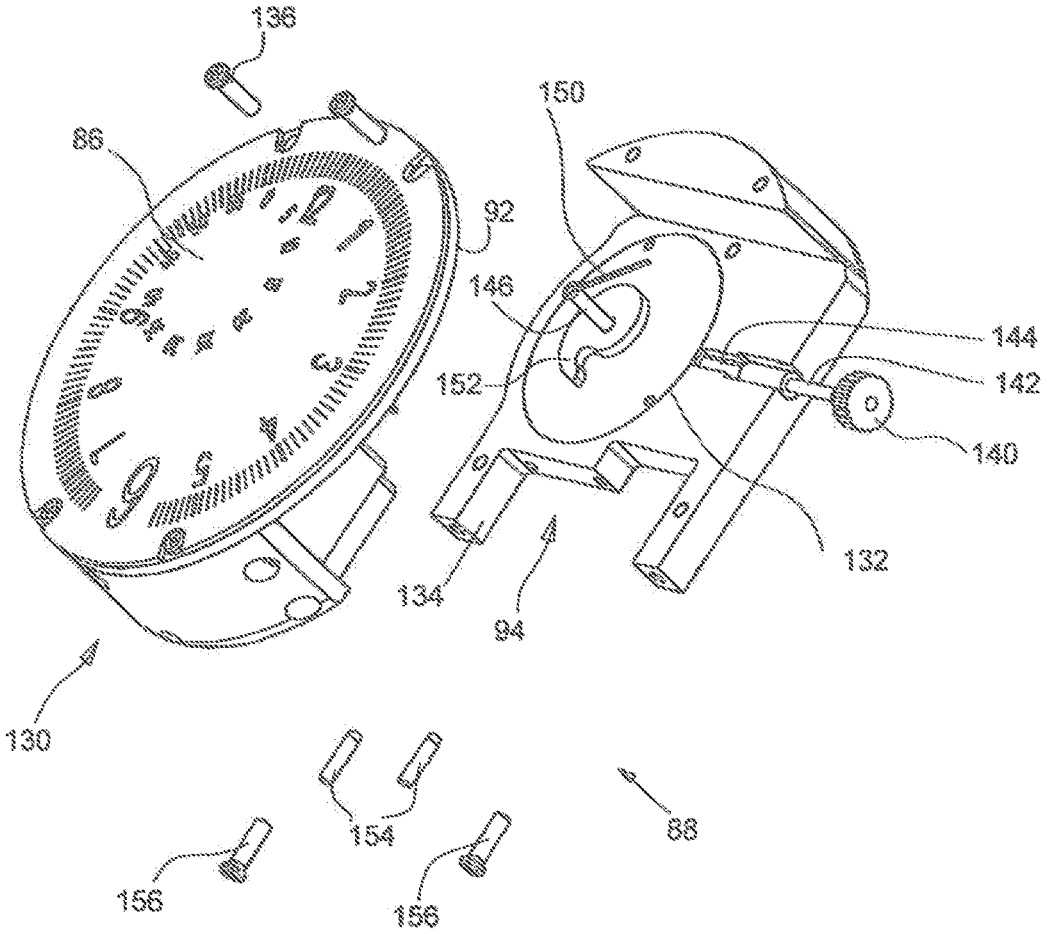
FIG. 8 is a perspective, partially exploded view of the face, capillary tube, fluid displacement device and watch movement of the invention.

Referring now to FIG. 8, the watch mechanism 88 includes a pumping subassembly 130 and a watch movement subassembly 94. The pumping subassembly 130 includes the dial 86, the capillary manifold 92 and the fluid displacement device 90 connected via screws 136. The watch movement subassembly 94 includes a watch movement 132, and a movement support 134. The watch movement 132 includes an time adjustment or crown 140 on a stem 142 around which is a stem tube 144, and an hour/second axis 146 on which is mounted a second hand 150 and a specialized cam 152. The pumping subassembly 130 and the watch movement subassembly 94 are mounted and aligned together with pins 154 and screws 156.

Figure 9:
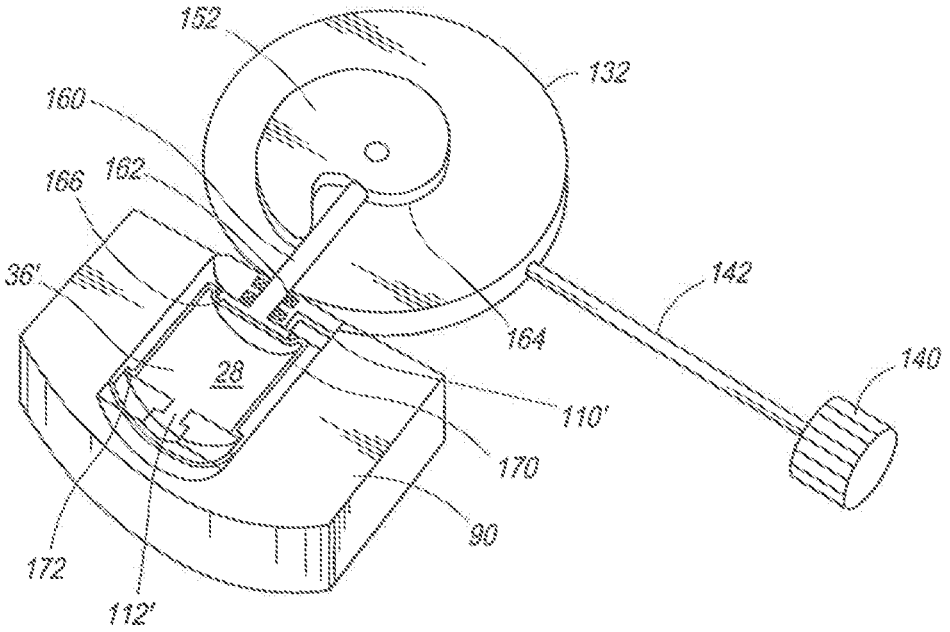
FIG. 9 is a partially disassembled view of the fluid displacement device of the invention, having one reservoir.

Referring now to FIG. 9, the cam 152 of the watch movement 132 connects to the fluid displacement device 90 via a piston shaft 160, mounted on sealed bearings 162 to axially translate, which is guided in its axial translation by a cam surface 164 thereof. The piston shaft 160 is connected to a piston head 166 which acts against a flexible rolling diaphragm 170 of a reservoir 36' (alternatively, of course the piston may have an O-ring mounted about it's periphery or otherwise be sealed, as shown in the embodiment of FIG. 3) The rolling diaphragm 170 has a flange 172 which is sealingly fixed at one end so as to effectively separate a fluid 28 from below the piston head 166, from a fluid 28' (which may include air as a fluid gas) above the piston. The reservoir 36' is shown in an extreme position. A passageway 112' leads to the capillary channel 102, and a passageway 110' provides a return passage to the opposite side of the piston head 166.

The cam 152 is formed resembling a nautilus spiral so as to progressively move the piston shaft 160 and therefore the piston head 166 to displace a determined amount of fluid 28 into the capillary channel 102, at a rate which will indicate the time accurately. Of course, a similar determined amount of drug or perfume may be administered to living organism in this manner as well It should be appreciated that the particular implementations shown and herein described are representative of the invention and its best mode and are not intended to limit the scope of the present invention in any way.

It should be appreciated that many applications of the present invention may be formulated.

As will be appreciated by skilled artisans, the present invention may be embodied as a system, a device, or a method.

Moreover, the system contemplates the use, sale and/or distribution of any goods, services or information having similar functionality described herein.

The specification and figures should be considered in an illustrative manner, rather than a restrictive one and all modifications described herein are intended to be included within the scope of the invention claimed. Accordingly, the scope of the invention should be determined by the appended claims (as they currently exist or as later amended or added, and their legal equivalents) rather than by merely the examples described above. Steps recited in any method or process claims, unless otherwise expressly stated, may be executed in any order and are not limited to the specific order presented in any claim. Further, the elements and/or components recited in apparatus claims may be assembled or otherwise functionally configured in a variety of permutations to produce substantially the same result as the present invention. Consequently, the invention should not be interpreted as being limited to the specific configuration recited in the claims.

Benefits, other advantages and solutions mentioned herein are not to be construed as critical, required or essential features or components of any or all the claims.

As used herein, the terms "comprises", "comprising", or variations thereof, are intended to refer to a non-exclusive listing of elements, such that any apparatus, process, method, article, or composition of the invention that comprises a list of elements, that does not include only those elements recited, but may also include other elements described in the instant specification. Unless otherwise explicitly stated, the use of the term "consisting" or "consisting of" or "consisting essentially of" is not intended to limit the scope of the invention to the enumerated elements named thereafter. Other combinations and/or modifications of the above-described elements, materials or structures used in the practice of the present invention may be varied or adapted by the skilled artisan to other designs without departing from the general principles of the invention.

The patents and articles mentioned above are hereby incorporated by reference herein, unless otherwise noted, to the extent that the same are not inconsistent with this disclosure.

Other characteristics and modes of execution of the invention are described in the appended claims.

Further, the invention should be considered as comprising all possible combinations of every feature described in the instant specification, appended claims, and/or drawing figures which may be considered new, inventive and industrially applicable.

Copyright may be owned by the Applicant(s) or their assignee and, with respect to express Licensees to third parties of the rights defined in one or more claims herein, no implied license is granted herein to use the invention as defined in the remaining claims. Further, vis-à-vis the public or third parties, no express or implied license is granted to prepare derivative works based on this patent specification.

Multiple variations and modifications are possible in the embodiments of the invention described here. Although certain illustrative embodiments of the invention have been shown and described here, a wide range of changes, modifications, and substitutions is contemplated in the foregoing disclosure. While the above description contains many specific details, these should not be construed as limitations on the scope of the invention, but rather exemplify one or another preferred embodiment thereof. In some instances, some features of the present invention may be employed without a corresponding use of the other features. Accordingly, it is appropriate that the foregoing description be construed broadly and understood as being illustrative only, the spirit and scope of the invention being limited only by the claims which ultimately issue in this application.

What is claimed is:

1. A wrist watch comprising:

a. a face on which time is indicated via a transparent capillary tube filled with a liquid;

b. a housing to which the face is attached, wherein further at least two bellows are enclosed in the housing, the bellows comprising: a bellows housing for storing the liquid in a storage volume contained therein, the bellows housing made of a flexible, watertight-material and comprising:

(i) an upper portion, (ii) a lower portion, (iii) an outer accordion formed portion having a length l and sealed seam sealingly connecting along upper and lower peripheries between the upper and lower portions, respectively, and (iv) at least one entry/exit port formed on at least one of the said portions thereof, wherein at least one of the upper and lower portions extends from a periphery of the accordion formed portion substantially within the housing so as to reduce the storage volume contained in the bellows housing; and c. a wristband.

2. The wrist watch of claim 1 used to control fluid flow in a capillary tube.

3. The wrist watch of claim 1 wherein the portion extending within the housing comprises an interface with an actuation device.

4. The wrist watch of claim 1, wherein the housing is made of a flexible, watertight material.

5. The wrist watch of claim 1, wherein at least one sealed seam is made via an adhesive or epoxy bond, a brazing, welding or soldering process.

6. The wrist watch of claim 1, wherein at least one sealed seam is made via a laser or ultrasonic welding process.

7. The wrist watch of claim 1, made, at least in part, of plastic.

8. The wrist watch of claim 1, made, at least in part, of a composite.

9. The wrist watch of claim 1 made, at least in part, of brass.

10. The wrist watch of claim 1 made, at least in part, of copper or a copper alloy.

11. The wrist watch of claim 1 made, at least in part, of beryllium copper.

12. The wrist watch of claim 1 made, at least in part, of a shape memory alloy.

13. The wrist watch of claim 1, made, at least in part, of aluminium.

14. The wrist watch of claim 1, electrocoated, at least in part, with a gold coating.

15. The wrist watch of claim 1, electrocoated, at least in part, with a titanium nitride coating.

16. The wrist watch of claim 1, electrocoated, at least in part, with a copper coating.

17. The wrist watch of claim 1, electrocoated, at least in part, with an oxide coating.

* * * * *